US007105134B2

(12) United States Patent
van Damme et al.

(10) Patent No.: US 7,105,134 B2
(45) Date of Patent: Sep. 12, 2006

(54) DEVICE FOR HOLDING A SUBSTRATE

(75) Inventors: Hendrik Sibolt van Damme, 's-Hertogenbosch (NL); Wilhelmus Marinus Carpay, Liempde (NL)

(73) Assignee: PamGene B.V., Den Bosh (NL)

( * ) Notice: Subject to any disclaimer, the term of this patent is extended or adjusted under 35 U.S.C. 154(b) by 461 days.

(21) Appl. No.: 10/095,992

(22) Filed: Mar. 11, 2002

(65) Prior Publication Data

US 2003/0059348 A1 Mar. 27, 2003

Related U.S. Application Data

(60) Provisional application No. 60/297,608, filed on Jun. 11, 2001.

(30) Foreign Application Priority Data

Mar. 13, 2001 (EP) ..... 01200947

(51) Int. Cl.
*B01L 9/00* (2006.01)

(52) U.S. Cl. ..... 422/104; 422/99; 422/100; 422/102

(58) Field of Classification Search ..... 422/99, 422/100, 102, 104
See application file for complete search history.

(56) References Cited

U.S. PATENT DOCUMENTS

| | | | | |
|---|---|---|---|---|
| 4,427,415 A | | 1/1984 | Cleveland | |
| 4,549,655 A | | 10/1985 | Forsythe, Jr. et al. | |
| 4,948,564 A | | 8/1990 | Lyman et al. | |
| 5,188,733 A | | 2/1993 | Wang et al. | |
| 5,234,840 A | | 8/1993 | Appleton | |
| 5,262,128 A | * | 11/1993 | Leighton et al. | 422/100 |
| 5,366,902 A | | 11/1994 | Cox et al. | |
| 5,843,767 A | | 12/1998 | Beattie | |
| 6,017,767 A | | 1/2000 | Chandler | |
| 6,225,131 B1 | * | 5/2001 | van Damme et al. | 436/524 |

FOREIGN PATENT DOCUMENTS

| | | |
|---|---|---|
| EP | 0 975 427 B1 | 3/2001 |
| WO | WO 87/07954 | 12/1987 |
| WO | WO 95/11755 | 5/1995 |
| WO | WO 97/15394 | 5/1997 |
| WO | WO 98/55852 | 12/1998 |
| WO | WO 99 23475 A | 5/1999 |
| WO | WO 99 61152 A | 12/1999 |
| WO | WO 00/24885 | 5/2000 |
| WO | WO 01/19517 | 3/2001 |

* cited by examiner

*Primary Examiner*—Jill Warden
*Assistant Examiner*—LaToya C. Younger
(74) *Attorney, Agent, or Firm*—Amster, Rothstein & Ebenstein LLP

(57) ABSTRACT

A device for holding a substrate comprises upper and lower plates adapted to receive the substrate sandwiched in the interface between the plates. Each plate has at least one opening with a projecting rim surrounding the opening and directed away from the interface. The openings in the upper and lower plates are preferably at least partially aligned in the sandwiched position of the plates. Each opening in the lower plate can be provided with a shielding member partially shielding the opening of the lower plate.

6 Claims, 3 Drawing Sheets

DEVICE FOR HOLDING A SUBSTRATE

This application claims priority to U.S. Provisional Patent Application Ser. No. 60/297,608, filed Jun. 11, 2001, European Patent Application 01200947.8, filed Mar. 13, 2001 and PCT/EP02/02446, filed Mar. 5, 2002.

BACKGROUND OF THE INVENTION (1) Field of the Invention

The present invention relates to a device for holding a substrate.

(2) Description of the Related Art

In WO 01/19517 of the same applicant an analytical test device is described made as a laminated array-membrane having upper and lower layers of plastic material and an intermediate strip of aluminium oxide. A plurality of areas of the strip of aluminium oxide are exposed by providing circular openings in the upper and lower layers. A drop of sample fluid is disposed in each of the areas and the sample fluid is transported through the capillary channels of the strip of aluminium oxide to perform an assay of the sample fluid by means of binding substances present in the capillary channels of the aluminium oxide strip.

BRIEF SUMMARY OF THE INVENTION

The present invention aims to provide a device for holding during performing an assay allowing to improve the range of sample fluid volumes which can be accommodated by the analytical test device or substrate.

According to the invention the device is characterized by upper and lower plates adapted to receive the substrate sandwiched in the interface between the plates, each plate having at least one opening with a projecting rim surrounding the opening and directed away from the interface.

By means of this device the substrate can be handled in an easy manner. Moreover, the opening or openings in the upper and lower plates surrounded by the projecting rings slow for a larger range of sample fluid volumes to be accommodated for performing an assay.

In a preferred embodiment each opening in the lower plate is provided with a shielding member partially shielding the opening of the lower plate. In this manner a real time reading of the substrate is possible when the sample fluid in each of the openings is transported to the lower side of the substrate as the sample fluid is largely screened by the shielding member avoiding any background signal caused by free label in the sample fluid.

The invention will be further explained by reference to the drawings showing an embodiment of the system of the invention.

DETAILED DESCRIPTION OF THE INVENTION

Figure 1:
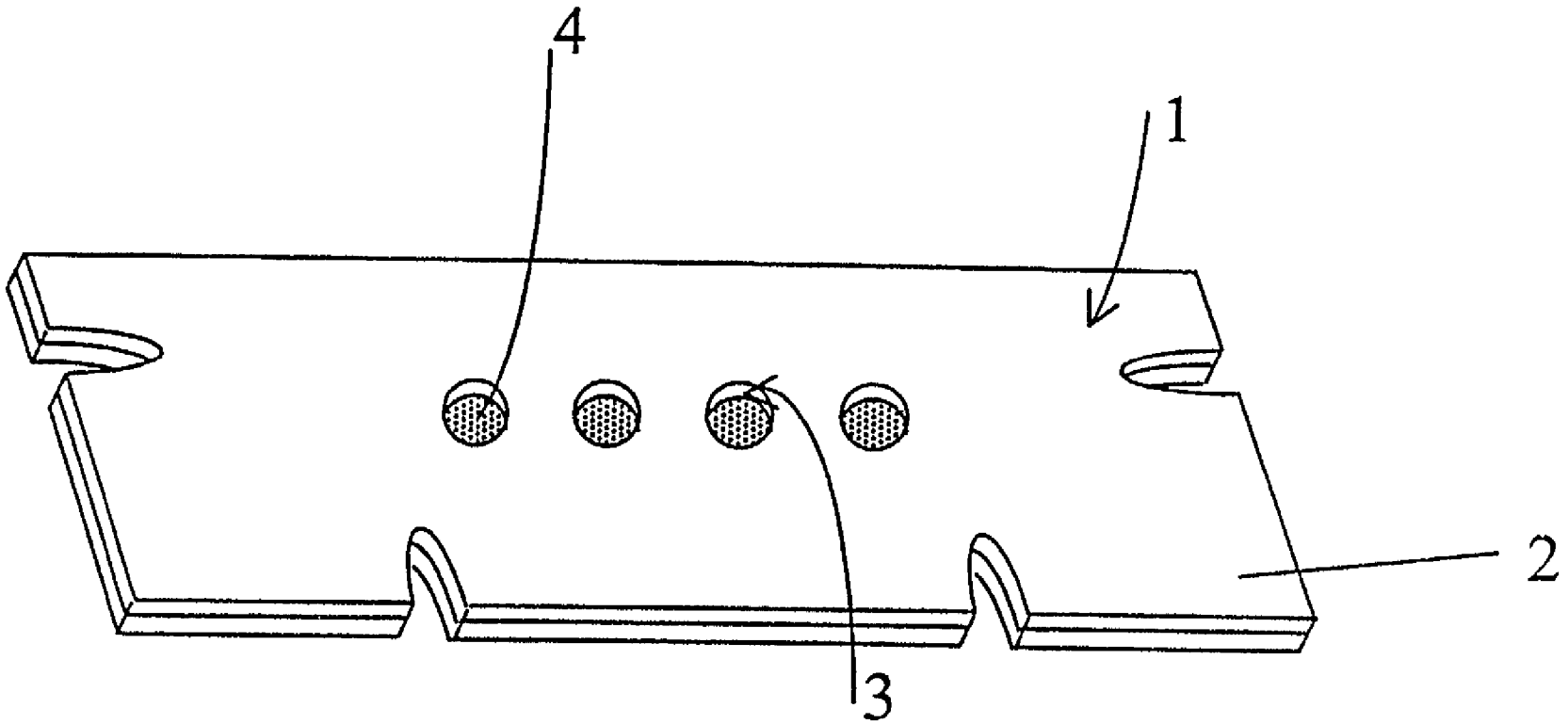
FIG. 1 shows a perspective view of an example of the substrate to be used in a device of the invention.

FIG. 1 shows by way of example an analytical test device or substrate 1 which is made as a laminated array-membrane comprising upper and lower outer layers 2 and an intermediate strip of aluminium oxide. The outer layers 2 are provided with four openings 3, the openings 3 of the upper and lower layers 2 being aligned. In this manner the strip of aluminium oxide is exposed at four areas or wells 4. The strip of aluminium oxide comprises a large number of through-going capillary channels oriented mainly perpendicular to the upper and lower surfaces of the strip. The capillary pressure of the channels is very high. In a practical embodiment of the substrate 1, the channels in the strip of aluminium oxide may have a spacing of approximately 150–200 nm, wherein a binding substance is bound to the substrate in groups of channels at a spacing of 200 μm. A group of channels can be indicated as a dot or dot area. Each area 4 of the substrate 1 may have approximately 400 dots. For a further description of the substrate reference is made to the above-mentioned international patent application PCT/US00/24885. It will be understood that the number of exposed areas of the substrate, the number of dots and the dimensions are mentioned by way of example only and may be varied as desired.

Figure 2:
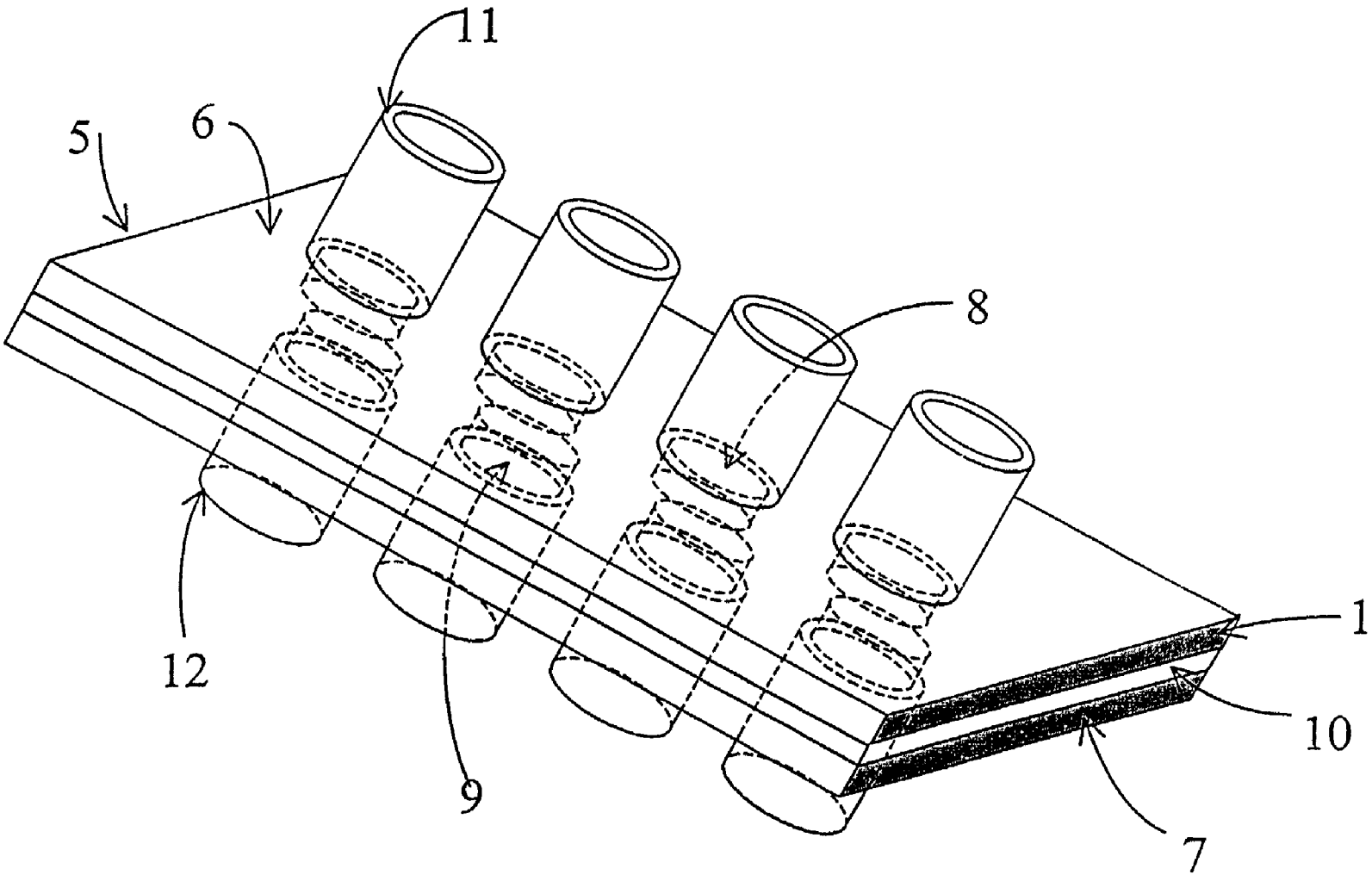
FIG. 2 shows a perspective view of an embodiment of the device of the invention.
Figure 3:
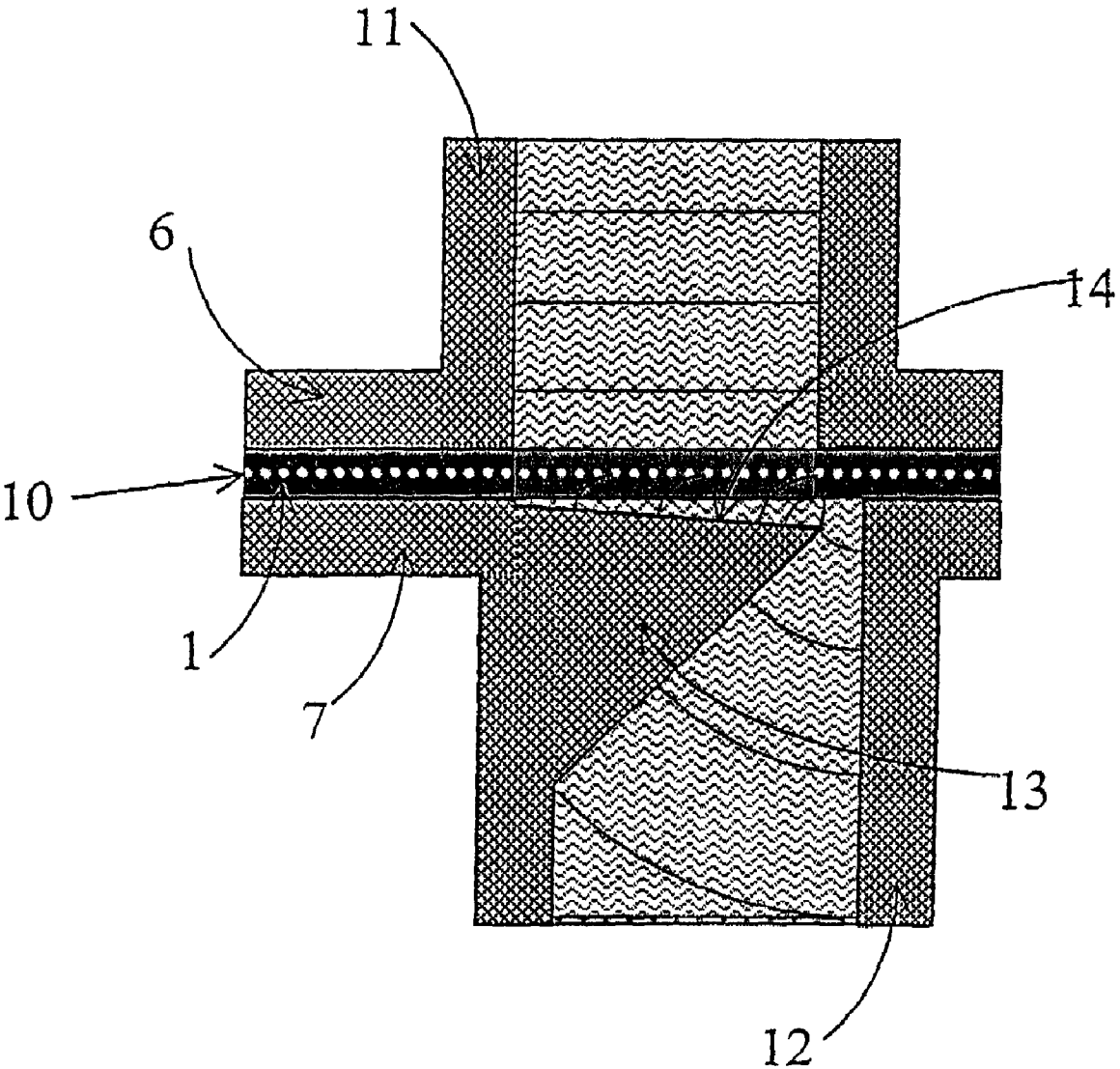
FIG. 3 shows a cross-section of the device of FIG. 2 through one of the openings with projecting rim, wherein the substrate of FIG. 1 is sandwiched in the interface between the upper and lower plates of the device.

FIGS. 2 and 3 show a device for holding the substrate 1 during performing an assay. The device 5 comprises upper and lower plates 6, 7, wherein in the embodiment shown each plate 6, 7 is provided with an array of four openings 8, 9. The upper and lower plates 6, 7 are made of a suitable plastic material in an injection moulding process for example. As shown in FIGS. 1 and 2 the upper and lower plates 6, 7 are adapted to receive the substrate 1 sandwiched in the interface 10 between the plates 6, 7. In the sandwiched position of the plates 6, 7, the openings 8, 9 are partially aligned, wherein the axes of openings 9 in the lower plate 7 are staggered with respect to the axes of openings 8 in the upper plate 6.

Each opening 8 of the upper plate 6 is surrounded by an upwardly projecting rim 11 and each opening 9 in the lower plate 7 is surrounded by a downwardly projecting rim 12. In the embodiment shown, the openings 8, 9 are circular and the rims 11, 12 are made as cylindrical structures.

As described in the above-mentioned international patent application PCT/US00/24885, a sample fluid disposed within the upper cylindrical structures 11 will pass through the capillary channels of the strip of aluminium oxide under an appropriate pressure difference over substrate 1. The cylindrical structures 11 allow for a larger range of sample fluid volumes to be accommodated.

In the device shown in the FIGS. 2 and 3, each opening 9 in the lower plate 7 is provided with a shielding member 13 partially shielding the opening 9. Each shielding member 13 has a wedge-shaped cross-section in the embodiment shown having a preferably flat upper surface 14 inclined with respect to the interface 10 of the plates 6, 7. In this manner a fluid passing through the capillary channels will gradually contact the upper surface 14 from the left to right according to the cross-section of FIG. 3 thus avoiding enclosing of air bubbles. The angle of inclination of the upper surface 14 of the shielding member 13 is preferably at least 5°.

As can be seen in FIG. 3 in particular, the staggering of the lower openings 9 with respect to the upper openings 8 allows for a complete screening of the openings 9 if the device 5 is viewed from the top side. In this manner a real time reading of the areas 4 of the substrate 1 is possible when the sample fluid is fully transported to the lower side of the substrate 1. Any background signal caused by free label in the sample fluid under the substrate 1 is avoided.

The shape of the shielding member 13 with the inclined upper surface 14 further improves the mixing of the sample fluid during transporting the sample fluid through the capillary channels of the substrate 1.

Other embodiments within the scope of the claims herein will be apparent to one skilled in the art from consideration of the specification or practice of the invention as disclosed herein. It is intended that the specification be considered exemplary only, with the scope and spirit of the invention being indicated by the following claims.

In view of the above, it will be seen that the several advantages of the invention are achieved and other advantages attained.

As various changes could be made in the above methods and compositions without departing from the scope of the invention, it is intended that all matter contained in the above description and shown in the accompanying drawings shall be interpreted as illustrative and not in a limiting sense.

All references cited in this specification are hereby incorporated by reference. The discussion of the references herein is intended merely to summarize the assertions made by the authors and no admission is made that any reference constitutes prior art. Applicants reserve the right to challenge the accuracy and pertinence of the cited references.

What is claimed is:

1. A device for holding a substrate, characterized by upper and lower plates adapted to receive the substrate sandwiched in the interface between the plates, each plate having at least one opening with a projecting rim surrounding the opening and directed away from the interface, wherein the openings in the upper and lower plates are at least partially aligned in the sandwiched position of the plates, wherein each opening in the lower plate is provided with a shielding member partially shielding the opening of the lower plate, wherein the opening(s) in the lower plate is (are) staggered with respect to the opening(s) in the upper plate, and wherein the shielding member(s) in the lower plate opening(s) fully shield the lower plate opening(s) with respect to the upper plate opening(s).

2. The device according to claim 1, wherein the shielding member(s) have a wedge-shaped cross-section.

3. A device for holding a substrate, characterized by upper and lower plates adapted to receive the substrate sandwiched in the interface between the plates, each plate having at least one opening with a projecting rim surrounding the opening and directed away from the interface, wherein the openings in the upper and lower plates are at least partially aligned in the sandwiched position of the plates, wherein each opening in the lower plate is provided with a shielding member partially shielding the opening of the lower plate, wherein each shielding member has an upper surface inclined at an angle of inclination with respect to the interface of the plates, wherein the opening(s) in the lower plate is (are) staggered with respect to the opening(s) in the upper plate, and wherein the shielding member(s) in the lower plate opening(s) fully shield the lower plate opening(s) with respect to the upper plate opening(s).

4. The device according to claim 3, wherein the shielding member(s) have a wedge-shaped cross-section.

5. A device for holding a substrate, characterized by upper and lower plates adapted to receive the substrate sandwiched in the interface between the plates, each plate having at least one opening with a projecting rim surrounding the opening and directed away from the interface, wherein the openings in the upper and lower plates are at least partially aligned in the sandwiched position of the plates, wherein each opening in the lower plate is provided with a shielding member partially shielding the opening of the lower plate, wherein each shielding member has an upper surface inclined at an angle of inclination with respect to the interface of the plates, wherein the angle of inclination of the upper surface of the shielding member is at least 5°, wherein the opening(s) in the lower plate is (are) staggered with respect to the opening(s) in the upper plate, and wherein the shielding member(s) in the lower plate opening(s) fully shield the lower plate opening(s) with respect to the upper plate opening(s).

6. The device according to claim 5, wherein the shielding member(s) have a wedge-shaped cross-section.

* * * * *